US006805174B2

(12) United States Patent
Smith et al.

(10) Patent No.: US 6,805,174 B2
(45) Date of Patent: Oct. 19, 2004

(54) DUAL STATION APPLICATOR WHEELS FOR FILLING CAVITIES WITH METERED AMOUNTS OF PARTICULATE MATERIAL

(75) Inventors: Barry S. Smith, Hopewell, VA (US); Steve Spiers, RIchmond, VA (US); Jeremy Straight, Midlothain, VA (US); Janet Thompson, Chesterfield, VA (US); Ahmet Ercelebi, Richmond, VA (US); Martin T. Garthaffner, Chesterfield, VA (US); Lisa Rogers, Richmond, VA (US)

(73) Assignee: Philip Morris USA Inc., New York, NY (US)

( * ) Notice: Subject to any disclaimer, the term of this patent is extended or adjusted under 35 U.S.C. 154(b) by 0 days.

(21) Appl. No.: 10/459,150

(22) Filed: Jun. 9, 2003

(65) Prior Publication Data

US 2004/0020554 A1 Feb. 5, 2004

Related U.S. Application Data

(60) Provisional application No. 60/400,353, filed on Jul. 31, 2002.

(51) Int. Cl.[7] ..... B65B 1/04

(52) U.S. Cl. ..... 141/67; 141/8; 141/12; 141/73; 141/103

(58) Field of Search ..... 141/8, 65, 67, 141/12, 71, 73, 100, 103, 144; 493/42, 48; 414/220

(56) References Cited

U.S. PATENT DOCUMENTS

| | | | | |
|---|---|---|---|---|
| 3,312,152 A | * | 4/1967 | Williamson | 493/497 |
| 3,570,557 A | * | 3/1971 | Molins | 141/99 |
| 4,425,107 A | * | 1/1984 | Hall | 493/48 |
| 5,875,824 A | | 3/1999 | Atwell et al. | |

* cited by examiner

*Primary Examiner*—Gregory L. Huson
*Assistant Examiner*—Peter deVore
(74) *Attorney, Agent, or Firm*—Connolly Bove Lodge & Hutz LLP

(57) ABSTRACT

Apparatus and method for filling spaced apart cavities with particulate material include a transport for moving the cavities along a path of travel. The cavities are partially filled with particulate material at an upstream location while applying vacuum underneath each cavity during such partial filling. The partially filled cavities are then completely filled with a downstream deposit of particulate material while applying vacuum to the upper sides of each cavity during such filling. The combination of vacuum applied underneath the cavity during partial fill and vacuum applied to the top sides of the cavity during complete fill produces approximately 100% cavity fill with minimal extraneous scatter of particulate material.

7 Claims, 2 Drawing Sheets

DUAL STATION APPLICATOR WHEELS FOR FILLING CAVITIES WITH METERED AMOUNTS OF PARTICULATE MATERIAL

This application claims benefits of Provisional Appl. 60/400,353 filed Jul. 31, 2002.

BACKGROUND OF THE INVENTION

The present invention generally relates to methods and apparatus for accurately delivering precisely metered amounts of particulate material from dual station applicator wheels in a repetitive manner during high speed manufacture of particulate-filled articles of manufacture, and more particularly to precise and repetitive delivery of granular carbon from dual station applicator wheels into spaces presented during the manufacture of plug-space-plug cigarette filters.

Certain articles of manufacture such as carbon cigarette filters, individual-sized packets of granular food products or condiments, capsuled pharmaceuticals, ammunition and the like require repetitive placement of precisely metered charges of particulate matter at some location along the production-line procession of the articles. During high speed mass production of such articles it is difficult to achieve consistent accurate filling of the desired cavities with the granular particles. In the case of filling cigarette filter cavities with carbon, it is desirable to avoid excessive pulverization and scattering of the particulate material, while achieving as close to 100% fill of the cavities as possible.

U.S. Pat. No. 5,875,824, which is incorporated by reference herein in its entirety, discloses a method and apparatus for delivering predetermined amounts of material, wherein a single metering wheel receives discrete amounts of material from a supply chute, with the discrete amounts of material being transferred from the metering wheel to a transfer wheel, and from the transfer wheel into spaces along a filter rod. As a result of the transfer of particles from one wheel to another, the pockets for receiving the particulate material in the transfer wheel must be larger than the pockets in the metering wheel. This arrangement makes it difficult to achieve 100% fill of the cavities in the article receiving particulate material from the transfer wheel.

According to the '824 patent, granular particles of carbon are drawn from a chute in communication with a reservoir into pockets on a rotating metering wheel. The rim of the metering wheel includes a plurality of equally spaced-apart pockets, each of which is defined by a radially directed, conical bore and a discrete screen at the base of the conical bore. The conical bore is convergent in the radially inward direction. A radially directed channel within the rim of the metering wheel communicates a backside of the screen with the interior of the metering wheel. A vacuum can be communicated from a stationary vacuum plenum in the interior of the metering wheel through the radial channel and screen such that any granular particles of the carbon that are adjacent the pocket in the metering wheel will be drawn into the conical bore of the pocket until it is filled.

SUMMARY OF THE INVENTION

An embodiment of the invention provides a method and apparatus for inserting granular particles of carbon or other materials into cavities defined in an article or plurality of articles, such as a cigarette filter rod, with the cavities being spaced at predetermined intervals. In the case of a cigarette filter rod, the cavities are spaced along the filter rod between filter components. In alternative embodiments the method and apparatus could include inserting particles or granules of other materials such as pharmaceuticals into cavities spaced along an article or in discrete articles such as individual capsules. Filling systems are provided adjacent upstream and downstream rotating applicator wheels each having spaced apart pockets that may be connected to a central stationary vacuum. The rotating wheels include pockets spaced around their outer surfaces, and a perforated metal band or screen which is clamped against the internal circumferential surface of the rotating wheels by a flexible segmented ring. The flexible segmented ring rotates with the wheel and has openings therethrough that coincide with the pockets around the outer surface of each rotating wheel. Each of the pockets is provided with a rectangular shape, extending inwardly until terminating at the perforated band or screen that is clamped against the inner circumference of the rotating wheel.

A stationary or rotatable vacuum plenum is provided in a drum radially inwardly from each rotating wheel and extending along an arc having a length coinciding with the distance between a point at which it is desired to provide vacuum to a pocket to draw in particles and a point at which it is desired to release the vacuum so that the particles can be released from the pocket into cavities traveling adjacent the periphery of the applicator wheels along a longitudinal path of travel.

The filling system adjacent to each rotating wheel includes a vertical drop chute with a height that is determined such that the particles accelerate under gravity through the drop chute and are traveling at approximately the surface speed of the rotating wheels when the particles enter the filling chamber. The filling chamber includes openings at the top to receive the particles from the vertical drop chute, at the bottom so that excess particles can drop out of the bottom of the filling chamber to be captured and recycled, and on the side of the filling chamber facing the rotating wheel. The side of the filling chamber opposite from the rotating wheel is provided with air inlets to allow cross air flow through the filling chamber and into the pockets of the rotating wheel. Each filling chamber can also be provided with optional deflector vanes to assist in deflecting the particles into the wheel pockets. As particles enter the top of the filling chamber from the vertical drop chute, cross air flow produced by the wheel vacuum and the inlets in the side of the filling chamber opposite from the wheel, direct the particles toward the wheel. The vacuum created by the stationary or rotatable internal vacuum plenum pulls the particles into the wheel pockets until the pockets are full. A scraper can be provided at the bottom of the filling chamber to scrap the outer surface of the wheel, thereby ensuring that each wheel pocket is accurately filled. A stationary air jet can also be provided inside the rotating wheel at a position adjacent the end of the vacuum plenum in the direction of rotation of the rotating wheel. The air jet directs a blast of air radially outwardly to assist in rapidly emptying each pocket of the rotating wheel as it rotates past the end of the vacuum plenum.

The cavities to be filled with the granules or particles are passed underneath each rotating applicator wheel and their movement is synchronized with the movement of the rotating wheels so that each cavity to be filled coincides with a pocket on the outer surface of each rotating wheel. A vacuum rail for conveying the article or articles having the cavities to be filled can also be provided. The material in which the cavities are formed can be porous material that allows the vacuum from the vacuum rail to create a negative pressure in the cavities. An example of such a porous material is the paper plug wrap used in forming cigarette filter rods. The vacuum rail can also be provided with separate chambers having higher and lower amounts of vacuum such that a chamber having the higher vacuum coincides with the cavity that is being filled with particles from the rotating wheel, while the other areas of the article coincide with the chambers having lower vacuum. The use of a high vacuum section in the vacuum rail at the point of particle transfer, and low vacuum at other points allows for quicker transfer of particles at the transfer point without having to adjust the rate at which the cavities are moved underneath the rotating wheel.

Both the upstream and downstream applicator wheels meter the particles and transfer the particles to cavities traveling underneath the wheels. The upstream wheel initially deposits a portion of the granular material into each cavity, and at the point of transfer from the upstream applicator wheel to the cavities, relatively high vacuum is applied to the cavities from below to draw in and affect transfer of the particulate material. The remaining portion of particulate material necessary for 100% cavity fill is transferred from the downstream applicator wheel to the partially filled cavities. At the location of the downstream applicator metering wheel relatively high vacuum is also applied at the point of transfer of the particulate material into the partially filled cavities, but such vacuum is applied at the upper sides of the cavity. Application of vacuum in this manner is instrumental in achieving approximately 100% fill of each cavity.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

The present invention provides a system useful for transferring accurately metered volumes of particles to cavities in an article or articles being produced at a high rate during mass production of the articles. The system includes upstream and downstream applicator wheels each of which rotates around a central stationary drum or vacuum plenum defining at least one vacuum chamber. A series of pockets are defined along an outer circumferential surface of each rotating applicator wheel between the outer periphery of the wheel and a perforated band or screen that is clamped against the inner periphery of the wheel, to both accurately meter and transfer predetermined amounts of granules or particles into cavities of one or more articles. Accurate metering and transfer of particles is achieved through the use of dual filling stations each of which includes a filling system that uses gravitational acceleration of the particles and cross air flow to achieve rapid filling of the pockets in each rotating applicator wheel, and a vacuum rail for transporting the article or articles that is used in conjunction with an air jet located inside each rotating wheel to ensure rapid emptying of the pockets in the rotating wheel and accurate filling of the cavities in the article moved along the vacuum rail.

The drawings illustrate an assembly line for producing cigarette filter rods of spaced apart cellulose acetate plugs with cavities therebetween filled with particulate material and surrounded by plug wrap. Initially the paper wrapped around the filter rod is left open at the top side of the filter rod as the filter rod passes by dual filling stations. Particles and granules of carbon are inserted into the spaced cavities along the filter rod through the openings on the top side of the filter rod as the rod passes under the filling stations. A first upstream filling station can be used for partially fill or completely fill a cavity, and then a second downstream filling station can top off the partially filled cavity or a filled cavity that has been compacted, or in which the particles have settled between the first and second filling station. At the upstream applicator wheel vacuum is applied to the plug wrap from below the cavity being filled, and at the downstream applicator wheel vacuum is applied to the top sides of the plug wrap to completely fill the partially filled cavity. This particular combination of vacuum application ensures 100% cavity fill. After the rod leaves the filling stations and continues to travel downstream, the paper plug wrap that has been left open at the top of the filter rod is folded over the filter components and particle filled cavities and glued and sealed to complete the filter rod construction.

Figures 1, 2, 3, 4, 5, 6, 7, 8:
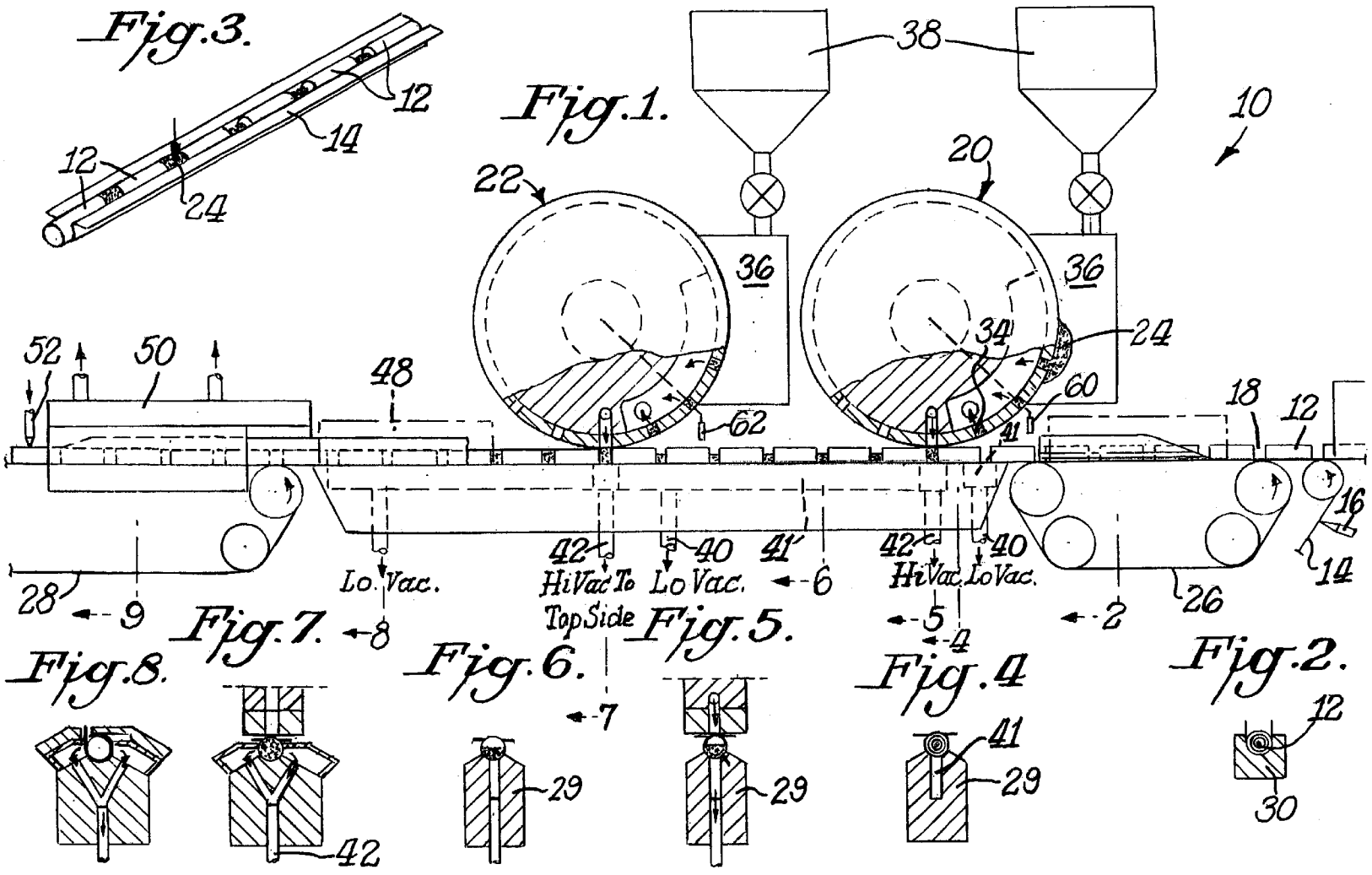
FIG. 1 is a diagrammatic side elevational view of a high speed apparatus that includes dual station applicator wheels for filling cavities with metered amounts of particulate material.
FIG. 2 is a sectional view taken along line 2—2 of FIG. 1.
FIG. 3 is a fragmental perspective view illustrating partially and completely filled cavities.
FIG. 4 is a sectional view taken along line 4—4 of FIG. 1.
FIG. 5 is a sectional view taken along line 5—5 of FIG. 1.
FIG. 6 is a sectional view taken along line 6—6 of FIG. 1.
FIG. 7 is a sectional view taken along line 7—7 of FIG. 1.
FIG. 8 is a sectional view taken along line 8—8 of FIG. 1.
Figure 9:
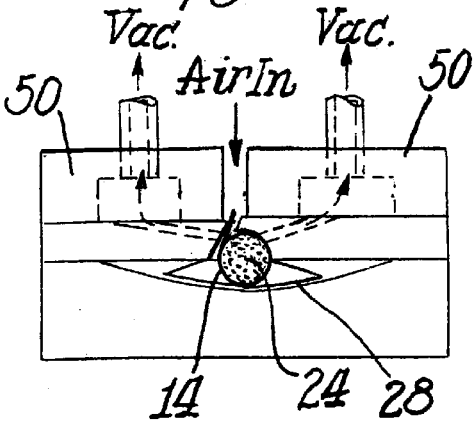
FIG. 9 is a sectional view taken along line 9—9 of FIG. 1.

Referring in more particularity to the drawings, FIG. 1 illustrates a diagrammatic side elevational view of high speed machinery 10 that includes dual station applicator wheels for filling cavities with metered amounts of particulate material in the manufacture of cigarette filter rods. Fundamentally, at the entrance to machinery 10 spaced apart plugs 12 of cellulose acetate are secured to plug wrap paper 14 by glue deposited onto paper 14 at glue applicator 16. The paper 14 is partially wrapped around the spaced apart plugs 12 but left open at the top side to thereby form spaces or cavities 18 between adjacent plugs traveling along a longitudinal path through the machinery 10. Upstream and downstream applicator wheels 20, 22 function to supply discrete portions of particulate material such as carbon 24 into the cavities 18, as explained more fully below. After the cavities are filled with the particulate material, the paper 14 is folded and glued in place around the cellulose acetate plugs and the filled cavities therebetween.

Upstream and downstream belts, 26 and 28 respectively, function to draw the plug wrap 14 with the spaced apart cellulose acetate plugs 12 secured thereto along a longitudinal path of travel through the machinery 10. A perforated vacuum rail 29 between the belts 26, 28 maintains the plug wrap and filter components in place along a longitudinal path of travel. Initially, as shown in cross section in FIG. 2, the plug wrap 14 is folded into a U-shaped configuration as the paper and plugs travel through a garniture 30. The paper continues to be folded into the configurations shown in FIGS. 4 and 5.

A portion of the particulate material 24 is deposited into each of the cavities 18 as they travel past the upstream applicator wheel 20. The applicator wheel 20 forms part of the first filling station and the wheel includes pockets 34 that receive carbon material 24 from a carbon chute 36. The carbon chute is supplied with carbon from a hopper 38. Vacuum is applied to the inner bottom surface of each pocket on the applicator wheel as the pockets travel past the carbon chute 36, and the carbon is thereby drawn into each of the pockets 34. Ultimately, when the pockets 34 filled with carbon 24 reach registration with the cavities 18, pressure is applied to urge the carbon out of pocket into the cavity.

As the cellulose acetate plugs 12 and plug wrap 14 approach the upstream applicator wheel 20 low vacuum 40 is applied to the underside of the plug wrap through the perforated vacuum rail 29 from a low vacuum plenum 41. Moreover, at the point of transfer of carbon 24 from the pockets of the first applicator wheel 20 into the cavities 18, high vacuum 42 is applied to the underside of the cavity from below the plug wrap. The application of pressure urging the carbon 24 out of pockets 34 on the applicator wheel in combination with the application of high vacuum below the cavities 18 functions to effectively transfer the carbon from the pockets of the applicator wheel into the cavities. Basically, the first applicator wheel 20 is constructed and arranged to partially fill each cavity 18 with carbon sufficient to fill the cavity approximately 30 to 60%, usually about 50%. Such partial fill is shown best in FIG. 6.

The filter rod assembly comprising the spaced apart cellulose acetate plugs 12 secured to the plug wrap 14 together with the partially filled cavities 18 travels in a downstream direction being pulled downstream by the downstream garniture belt 28. Low vacuum 40 is applied to the underside of this assembly as it travels from the first upstream applicator wheel 20 to the second downstream applicator wheel 22 where the remainder of each cavity is filled with carbon 24.

The second applicator wheel 22 forms part of the second filling station and is similar in construction to applicator wheel 20. When the partially filled cavities are in registration with the pockets 34 of the second applicator wheel, the remaining carbon necessary to completely fill the cavity is transferred from the pockets to the cavities by pressure applied to the underside of each pocket at its transfer location and also by high vacuum applied to the cavity. However, as shown best in FIG. 7, the application of high vacuum is directed to the top side of the cavity on the outside of the plug wrap and such application functions to hold the carbon within the cavity for approximately 100% cavity fill.

The application of high vacuum to the underside of the cavity during carbon transfer at the first filling station in combination with the application of high vacuum to the top side of the cavity during the transfer of carbon at the second filling station ultimately produces a fully filled cavity with minimal scatter of the carbon onto the adjacent cellulose acetate plugs 12. The release of carbon 24 by both applicator wheels 20, 22 begins at the hour hand position of 4:30. This is where air is applied to the pocket and the transfer of carbon begins. Transfer is completed at the 6:00 position.

Upon moving past the second downstream applicator wheel 22 the plug wrap filter paper 14 is folded around the filled cavities 18 and cellulose acetate plugs 12 in a pre-exit folder 48, as shown in FIG. 8. Ultimately, the filled cavities and cellulose acetate plugs pass through an exit folder 50 where the paper 14 is almost completely folded around the plugs and filled cavities except for an upstanding glue flap portion of the plug wrap. Glue is applied to the flap at station 52 and the flap is folded down to thereby produce a cylindrical filter rod comprising spaced apart plugs 12 and carbon filled cavities 18 with plug wrap 14 wrapped around the plugs and cavities and glued in place. Front and rear vacuum folders 50 cause air flow to occur down through folders 50 by drawing air through the plug wrap. This downstream air flow maintains the 100% fill in cavities 18.

Figure 10:
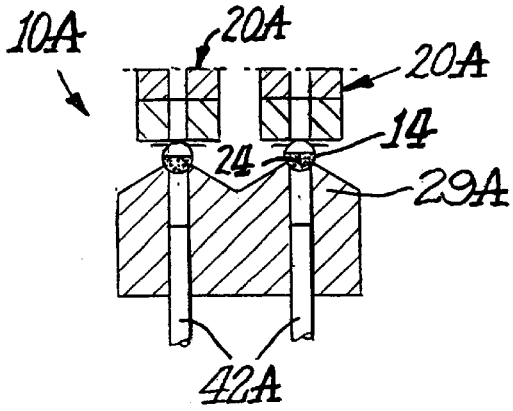
FIG. 10 is a sectional view illustrating an alternate embodiment of the present invention wherein the upstream and downstream filling stations each include a pair of side-by-side applicator wheels.

FIG. 10 shows an alterative embodiment 10A where each filling station includes side by side applicator wheels to thereby accommodate parallel paths of travel for simultaneous manufacture of two filter rods. In the embodiment of FIG. 10 duplicate lines are formed, but otherwise each path of travel is the same as described above.

Machinery 10, 10A also includes a first upstream sensor 60 at a location just upstream of the first applicator wheel 20 for adjusting the phase of the wheel with respect to the appearances of the cavities 18 at the sensor location. A second sensor 62 is positioned just upstream of the downstream applicator wheel 22 to likewise adjust the phase of the second applicator wheel to precisely correspond with the phase of the arrival of the cavities 18 between the cellulose acetate plugs 12 approaching the nip of the second applicator wheel.

As described above, the present invention utilizes two or more applicator metering wheels such that the upstream metering wheel 20 effects partial filling of the cavities while the downstream applicator wheel 22 completes the filling operation so as to maximize the percent fill of the cavities on a constant basis. This arrangement enhances machine speed operation and also provides the capacity to include different adsorbents in the same cavity of plug-space-plug filter constructions. In this regard, the pockets 34 of the first upstream applicator wheel 20 may be charged with one adsorbent while the pockets of the downstream applicator wheel 22 may be charged with a totally different adsorbent to thereby produce an adsorbent combination in each cavity.

The present invention provides arrangements of how much and from where vacuum is drawn at and about the upstream and downstream applicator wheels to thereby completely fill the cavities between the cellulose acetate plugs while avoiding ricochet and/or escape of the adsorbent particles being charged into the cavities.

In the region of the entrance pathway adjacent both the upstream and downstream applicator wheels low vacuum of about 30 millibars is drawn from beneath the plug wrap 14 except at the nip of the applicator wheels where a relatively high vacuum of about 70 millibars is drawn from beneath the plug wrap to ensure a complete and quick transfer of the carbon from the pockets of the applicator wheels into the cavities 18.

Just upstream of the nip of the second downstream metering wheel 22, the partially filled pockets and plugs enter a garniture section that is configured to draw elevated vacuum from along the sides of the folded-open plug wrap. As explained above, vacuum is not drawn from beneath the plug wrap. The elevated drawing of vacuum along the sides promotes a speedy and clean transfer of carbon from the pockets 34 of second metering wheel 22 to the partially filled cavities 18, and promotes retention while minimizing scatter of the particulate 24. Soon after passing through the nip, the procession of plugs enters a top folder garniture portion, wherein a lesser (~30 millibars) vacuum is drawn in the same manner along the sides instead of from below.

Accordingly, in the present invention a high vacuum is drawn adjacent only the delivery point of each wheel and such vacuum is drawn from beneath the first wheel 20 but only along the sides of the plug wrap 14 at the second wheel 22. This is a profound change and found effective for controlling scatter while achieving high machine speeds and 100% cavity fill.

Machinery 10, 10A also includes a master drive system (not shown) that operates the following:

the drive units of the plug hoppers and the first garniture belt 26;

the motor of the spacer drum;

the drive units of the upstream and downstream applicator metering wheels 20; 22;

the second garniture belt 28; and a cutter head for severing the continuous filter rod into desired lengths.

Aspects include adjusting the speed of the second belt 28 to achieve desired rod output of the system and determining speeds of all other units relative to that desired, second belt speed. Furthermore, the first belt 26 is driven slightly less than (~0.07%) or equal to the speed of the second tube belt 28 so as to avoid bunching of the rod under construction. A cutter head (not shown) is adjustable in phase to maintain registration of the cut respective to internal plug structure. Sensors 60, 62 adjacent the metering wheels allow for adjustment of the phase of each metering wheel relative to the phase of passing plugs, as explained above.

One skilled in the art will appreciate that the present invention may be practiced by embodiments other than the above-described embodiments, which have been presented for purposes of illustration and not of limitation. The device and methodologies embodied in the above-described embodiments are adaptable to delivering various types of particulate or granular material and could be used in applications other than the filling of portions of cigarette filters. For example, the device is readily adaptable to the filling of pharmaceutical doses, or the repetitive displacement of powdered food stuffs or other powdered, granular or particulate products into discrete packaging or containers.

What is claimed is:

1. Apparatus for filling spaced apart cavities with particulate material comprising:

a transport for moving the cavities along a path of travel;

a first filling station for partially filling the cavities including an upstream applicator wheel with spaced apart pockets on the periphery thereof;

a first supply of particulate material adjacent the upstream applicator wheel for depositing the material into the pockets;

first transfer means for transferring the particulate material from the pockets to partially fill the cavities including the application of vacuum underneath the cavity being partially filled at a point of transfer of the particulate material from the pockets into the cavities;

a second filling station for completely filling the partially filled cavities including a downstream applicator wheel with spaced apart pockets on the periphery thereof;

a second supply of particulate material adjacent the downstream applicator wheel for depositing the material from the second supply into the pockets; and second transfer means for transferring the particulate material from the pockets of the downstream applicator wheel into the cavities including the application of vacuum to the upper sides of the cavity being filled at a point of transfer of the particulate material from the pockets of the downstream applicator wheel into the cavities.

2. An apparatus as in claim 1 wherein the particulate material in the first supply and the second supply is the same.

3. An apparatus as in claim 1 wherein the first and second transfer means includes the application of relatively lower vacuum to the underside of the cavities immediately upstream of the points of transfer.

4. A method for filling spaced apart cavities with particulate material comprising the steps of:

transporting spaced apart cavities along a path of travel;

partially filling each cavity with particulate material while applying vacuum underneath each cavity during such filling; and completely filling each cavity with particulate material while applying vacuum to the upper sides of the cavity during such filling.

5. A method as in claim 4 wherein the cavities are partially and then completely filled with the same particulate material.

6. A method as in claim 4 wherein the cavities are partially filled with one particulate material and then completely filled with a different particulate material.

7. A method as in claim 4 further including the steps of:

applying vacuum underneath the cavities immediately upstream of the partial filling step and the complete filling step.

* * * * *